US006231809B1

(12) United States Patent
Matsumoto et al.

(10) Patent No.: US 6,231,809 B1
(45) Date of Patent: May 15, 2001

(54) AL-MG-SI ALUMINUM ALLOY SHEET FOR FORMING HAVING GOOD SURFACE PROPERTIES WITH CONTROLLED TEXTURE

(75) Inventors: Katsushi Matsumoto, Kobe; Masahiro Yanagawa, Tokyo; Yasuo Takaki, Moka, all of (JP)

(73) Assignees: Kabushiki Kaisha Kobe Seiko Sho (Kobe Steel, Ltd.), Kobe; Kobe Alcoa Transporation Products Ltd., Tokyo, both of (JP)

( * ) Notice: Subject to any disclaimer, the term of this patent is extended or adjusted under 35 U.S.C. 154(b) by 0 days.

(21) Appl. No.: 09/375,465

(22) Filed: Aug. 17, 1999

(30) Foreign Application Priority Data

Feb. 20, 1998 (JP) ..... 10-056159

(51) Int. Cl.[7] ..... C22C 21/06; C22C 21/08

(52) U.S. Cl. ..... 420/535; 148/438; 148/439; 148/440

(58) Field of Search ..... 420/534; 148/438, 148/439, 440

(56) References Cited

U.S. PATENT DOCUMENTS 5,810,949 * 9/1998 Chakrabarti et al. ..... 148/535
6,117,252 * 9/2000 Bartlat et al. ..... 148/439

* cited by examiner

*Primary Examiner*—Roy King
*Assistant Examiner*—Nicole Coy
(74) *Attorney, Agent, or Firm*—Oblon, Spivak, McClelland, Maier & Neustadt, P.C.

(57) ABSTRACT

An Al—Mg—Si type alloy sheet contains 0.2 to 1.5 wt % of Mg and 0.2 to 1.5 wt % of Si. The sheet has textures in which orientation distribution density of Goss orientation is 3 or lower, orientation distribution density of PP orientation is 3 or lower and orientation distribution density of Brass orientation is 3 or lower. The sheet may contain 0.01 to 1.5 wt % in total weight of one or more elements selected from the group consisting of Mn, Cr, Fe, Zr, V and Ti. The sheet may further contain 0.01 to 1.5 wt % in total weight of one or more elements selected from the group consisting of Cu, Ag, Zn and Sn. Thus, ridging marks is restrained in the aluminum alloy sheet.

6 Claims, No Drawings

AL-MG-SI ALUMINUM ALLOY SHEET FOR FORMING HAVING GOOD SURFACE PROPERTIES WITH CONTROLLED TEXTURE

BACKGROUND OF THE INVENTION

1. Field of the Invention

The present invention relates to an Al—Mg—Si aluminum alloy sheet (hereinafter referred to as "Al—Mg—Si sheet") having good press-formability and, in particular, good surface properties. More specifically, the present invention relates to an Al—Mg—Si sheet for forming which is desirable to be used, for example, as a building material for roofs, interior members, curtain walls and the like, and as a material for utensils, electrical parts, optical instruments, vehicles such as automobiles, railcars, and aircraft, general mechanical parts and the like.

2. Related Art

Conventionally, an Al—Mg alloy has been mainly used as an aluminum alloy sheet having good formability. The Al—Mg alloy has, however, drawbacks such that baking hardenability is low, and that stretcher strain marks are liable to be produced when it is subjected to press forming. Therefore, an Al—Mg—Si alloy is attracting notice as an alloy to replace the Al—Mg alloy. The Al—Mg—Si alloy has advantages such that it has good cold formability and high corrosion resistance, and obtains high strength by aging treatment.

However, as described in Japanese Patent Preliminary Publication No. Hei 7-228956 and Japanese Patent Preliminary Publication No. Hei 8-232052, there is a problem that when an Al—Mg—Si alloy sheet is subjected to forming, surface roughness called "ridging marks" is produced on the sheet surface. The ridging marks are stripe-like irregularities which are produced in the direction parallel to the direction of rolling when the sheet is subjected to forming. They are produced conspicuously especially when forming such as stretch forming, ironing, deep drawing or bulging is applied to the sheet in the direction perpendicular to the direction of rolling. A sheet with ridging marks cannot be used for products which particularly require a fine surface such as an interior member, a camera case, an exterior sheet for an automobile and the like, because of its defective appearance.

Japanese Patent Preliminary Publication No. Hei 7-228956 and Japanese Patent Preliminary Publication No. Hei 8-232052 mentioned above intend to prevent production of ridging marks by strictly controlling conditions in each process such as conditions in hot rolling to thereby produce crystal grains which are fine and random in crystal orientation.

However, those prior art documents do not find out the composition of a sheet in which ridging marks are not produced, and cannot sufficiently meet a recent strict demand for quality of a surface.

The Al—Mg—Si aluminum alloy disclosed in Japanese Patent Preliminary Publication No. hei 8-325663 was developed with attention focused on stretchability, while no consideration was paid to the surface properties. Therefore, the alloy cannot sufficiently meet a recent strict demand for quality of a surface.

SUMMARY OF THE INVENTION

The object of the present invention is to provide an Al—Mg—Si aluminum alloy sheet for forming in which ridging marks are prevented from being produced and quality of a surface is superior.

The inventors of the present invention has found out that in order to restrain the production of ridging marks in an Al—Mg—Si alloy sheet, it is effective to perform texture control precisely to thereby reduce textures of Goss orientation, PP orientation and Brass orientation in a final product.

Specifically, an Al—Mg—Si alloy sheet having good surface properties as a material for forming according to the present invention has textures in which orientation distribution density of Goss orientation is 3 or lower, orientation distribution density of PP orientation is 3 or lower and orientation distribution density of Brass orientation is 3 or lower.

As long as an Al—Mg—Si alloy has textures as described above, production of ridging marks are restrained. An especially desirable Al—Mg—Si alloy according to the present invention contains 0.2 to 1.5% of Mg and 0.2 to 1.5% of Si. The Al—Mg—Si type alloy may contain one or more elements selected from the group consisting of Mn, Cr, Fe, Zr, V and Ti in a total amount of 0.01 to 1.5 wt % on the condition that Mn is in a quantity of 1.0 wt % or less, Cr is in a quantity of 0.3 wt % or less, Fe is in a quantity of 1.0 wt % or less, Zr is in a quantity of 0.3 wt % or less, V is in a quantity of 0.3 wt % or less and Ti is in a quantity of 0.1 wt % or less. Also, the Al—Mg—Si type alloy may contain one or more elements selected from the group consisting of Cu, Ag, Zn and Sn in a total amount of 0.01 to 1.5 wt % on the condition that Cu is in a quantity of 1.0 wt % or less, Ag is in a quantity of 0.2 wt % or less, Zn is in a quantity of 1.0 wt % or less and Sn is in a quantity of 0.2 wt % or less.

The present invention can provide an Al—Mg—Si type alloy sheet as a material for forming in which production of ridging marks is restrained.

DETAILED DESCRIPTION OF THE PREFERRED EMBODIMENTS

After various research on the cause of ridging marks which are produced when a conventional aluminum alloy is subjected to press forming, the inventors have found out that production of ridging marks is due to insufficient texture control.

Here, textures of an aluminum alloy will be described. In an aluminum alloy, there exist orientation components of Cube orientation, RW orientation, CR orientation, Brass orientation, Goss orientation, PP orientation, C orientation and S orientation, which are as follows:

Cube orientation . . . {001}<100>
RW orientation . . . {001}<110>
CR orientation . . . {001}<520>
Brass orientation . . . {011}<211>
Goss orientation . . . {011}<100>
PP orientation . . . {011}<122>
C orientation . . . {112}<111>
S orientation . . . {123}<634>.

In the present invention, an orientation component deviating from one of the above exact orientation by ±10 degrees or less is basically considered to belong to that orientation component. Only regarding Brass orientation and PP orientation component, an orientation deviating from exact Brass or PP orientation by ±8 degrees or less is considered to belong to Brass or PP orientation component.

An ordinary aluminum alloy is composed of textures of the above orientation components. If the composition ratio changes, plastic anisotropy (described later) of a sheet changes and press formability becomes better or worse.

Quantitative evaluation of orientations is performed by orientation distribution density. Orientation distribution density is represented by ratio of magnitude of an orientation to magnitude of a random orientation, and obtained by measuring at least three conventional pole figures by an ordinary X-ray diffraction method and using crystallite orientation distribution function [see Reference 1: Shin-ichi Nagashima, "Texture" (published by Maruzen Kabushiki Kaisha) 1984, pp. 8–44; Reference 2: Metallurgical Society Seminar, "Texture" (edited by Metallurgical Society of Japan) 1981, pp. 3–7]. Alternatively, orientation distribution density can be obtained based on data obtained by electron beam diffraction method, SEM(Scanning-Electron-Microscopy)-ECP (Electron-Channeling-Pattern) method, SEM-EBSP (Electron-Back-Scattered-Pattern) method or the like measuring crystallite orientation distribution. Since the orientation distribution varies in the direction of thickness of a sheet, the average of orientation distribution densities at some points arbitrarily chosen in the direction of thickness is calculated.

The inventors researched on the mechanism of producing ridging marks, varying textures of Al—Mg—Si alloy sheets and examining whether ridging marks were produced in those sheets, and found out that Goss orientation, PP orientation and Brass orientation which show strong in-plane plastic anisotropy cause ridging marks.

Specifically, in Goss orientation, PP orientation and Brass orientation, r-value (Lankford value) shows in-plane plastic anisotropy far larger than in other orientations. More specifically, in Goss orientation, PP orientation and Brass orientation, reduction in thickness of a sheet is hardly caused by pulling the sheet in the direction of width of the sheet, in the direction at an angle of 20° to the direction of rolling, and in the direction at an angle of 550 to the direction of rolling, respectively, while the reduction in thickness is caused by pulling the sheet in the other directions. This large difference in thickness reduction rate causes irregularities on a surface (ridging marks).

Therefore, in order to restrain production of ridging marks, it is effective to reduce textures of Goss orientation, PP orientation and Brass orientation. Specifically, when orientation distribution density of Goss orientation is 3 or lower, orientation distribution density of PP orientation is 3 or lower and orientation distribution density of Brass orientation is 3 or lower, production of ridging marks is restrained. On the other hand, if orientation distribution density of one of those orientations exceeds the above, ridging marks are produced conspicuously and quality of a surface deteriorates. It is preferable that orientation distribution density of Goss orientation is 2 or lower, orientation distribution density of PP orientation is 2 or lower and orientation distribution density of Brass orientation is 2 or lower.

Next, alloying elements of Al—Mg—Si alloy will be described.

(Mg, Si)

These elements are important in that they form aggregates (clusters) of $Mg_2Si$ called "GP zones" or intermediate phases, and contribute to hardening by baking. They also play a part in improving the work hardening property of a sheet and raising the fracture limit in press forming. Further, stable phases of $Mg_2Si$ produced during soaking act as preferred sites for formation of nucleuses of recrystallization orientations, and have a large effect on formation of textures of a sheet.

When Mg content and Si content are each lower than 0.2 wt %, a sufficient strength can not be obtained by baking. When Mg content and Si content each exceed 1.5 wt %, hardening-by-baking property becomes worse, and formability becomes worse due to formation of coarse compounds from which fracture is liable to occur. Further, formation of desired textures is hindered. It is better that Mg content is 0.8% or lower and Si content is 1.3% or lower.

(Mn, Cr, Fe, Zr, V, Ti)

Mn, Cr, Zr, V and Ti form a large quantity of fine dispersoids when soaking is performed for a long time of 4 hours or longer at a high temperature of 530° C. or higher. The dispersoids act as preferred sites for formation of crystal nucleuses of recrystallization orientations, and are effective in obtaining desired textures. The dispersoids are also effective in making grains finer and thereby raising the cracking limit in forming. Further, Mn and Cr are important in that they contribute to hardening by baking. However, if Mn content exceeds 1.0 wt %, Cr content exceeds 0.3 wt %, Zr content exceeds 0.3 wt %, V content exceeds 0.3 wt % or Ti content exceeds 1.0 wt %, coarse compounds from which fracture is liable to occur are formed, so that formability becomes much worse. Formation of desired textures is also hindered.

Fe forms constituent phase such as $Al_7Cu_2Fe$, $Al_{12}(Fe, Mn)_3Cu_{12}$, $(Fe, Mn)Al_6$, α-AlFeSi, β-AlFeSi and the like. Those constituent phase act as preferred sites for formation of nucleuses of recrystallization orientations, and are effective in obtaining desired textures. However, if Fe content exceeds 1.0 wt %, coarse compounds from which fracture is liable to occur are formed, so that formability becomes much worse. Formation of desired textures is also hindered.

When the content of the above elements in all is lower than 0.01 wt %, the above described effects are not obtained. When the content of the above elements in all exceeds 1.5 wt %, coarse compounds from which fracture is liable to be occur are formed, so that formability becomes much worse. Formation of desired textures is also hindered.

An especially desirable range of quantity of each element is as follows: Mn content is 0.5 wt % or lower, Cr content is 0.2 wt % or lower, Fe content is 0.5 wt % or lower, Zr content is 0.2 wt % or lower, V content is 0.2 wt % or lower, and Ti content is 0.05 wt % or lower.

(Cu, Ag, Zn, Sn)

These elements promote formation of aggregates (clusters) of $Mg_2Si$ called "GP zones" or intermediate phases. Cu, Ag and Zn have an action of accelerating hardening by baking. Sn has an action of restraining room temperature aging in stages before baking, and promoting aging in baking. However, when the content of the above elements in all is lower than 0.01 wt %, the above described effects are not obtained. On the other hand, when Cu content exceeds 1.0 wt %, Ag content exceeds 0.2 wt %, Zn content exceeds 1.0 wt %, Sn content exceeds 0.2 wt %, or the sum of contents of those elements exceeds 1.5%, coarse compounds from which fracture is liable to occur are formed, so that formability becomes worse. Formation of desired textures is also hindered.

An especially desirable range of quantity of each element is as follows: Cu content is 0.5 wt % or lower, Ag content is 0.1 wt % or lower, Zn content is 0.5 wt % or lower, and Sn content is 0.1 wt % or lower.

Next, desirable conditions of fabrication will be described.

After ordinary casting, soaking is performed. In the case where transition metals such as Mn, Cr, Fe, Zr, V and the like are added, if soaking is performed for a long time of 4 hours or longer at a high temperature of 530° C. or higher, a large quantity of fine dispersoids can be precipitated. The dispersoids are effective in obtaining desirable textures and making grains finer. Then, hot rolling is performed, and then cold rolling is performed. When starting temperature of hot rolling is higher than 450° C., coiling temperature of hot rolling is higher than 360° C. and final reduction rate of cold rolling is 85% or lower, desired textures can be obtained. Annealing may be performed after hot rolling.

For obtaining desired textures, what is of special importance is the fact that development of α-fiber [see reference 3: Kunio Ito, "Light metal" Vol. 43 (1993), No. 5, pp. 285–293] in an alloy before solution heat treatment, in which orientations whose <110> axis is normal to a rolling plane, such as Goss orientation and Brass orientation, belong, causes development of Goss orientation, PP orientation and the like after solution heat treatment. Therefore, the development of α-fiber in stages before solution heat treatment needs to be restrained. α-fiber develops during hot rolling. Further, in cold rolling, the higher the reduction is, the more α-fiber develops. Therefore, in order to restrain the development of α-fiber, it is necessary to make the coiling temperature of hot rolling higher to cause recrystallization to thereby restrain the development of α-fiber during hot rolling, or to lower the reduction of cold rolling to thereby restrain the development of α-fiber during cold rolling. Specifically, it is desirable that the coiling temperature of hot rolling is 360° C. or higher and the final reduction of cold rolling is 85% or lower. Further, when hot rolling is started at a temperature higher than 450° C., recrystallization occurs easily during rolling, so that orientations not belonging in α-fiber are formed and the development of α-fiber is reduced. By restraining the development of α-fiber in an alloy before solution heat treatment in this way, development of Goss, Brass, PP orientations in the alloy after solution heat treatment is restrained. This contributes to restraining production of ridging marks.

It is to be noted that the development of α-fiber due to hot rolling may be reduced by performing annealing after hot rolling to thereby cause recrystallization.

Solution heat treatment is performed last. It is desirable that a high temperature of 530° C. is maintained in the solution heat treatment.

EXAMPLE 1

Alloys of three different compositions, that is, Al-0.6%Mg-1.0%Si alloy (hereinafter referred to as "base alloy"), Al-0.6%Mg-1.0%Si-0.1%Mn alloy (hereinafter referred to as "Mn-added alloy", and Al-0.6%Mg-1.0%Si-0.1%Fe alloy (hereinafter referred to as "Fe-added alloy" were cast in an ordinary way, and subjected to soaking at a temperature of 550° C. for 8 hours. Then, the alloys were subjected to hot rolling (started at a temperature of 500° C.) and thereby formed from sheets of thickness of 500 mm into sheets of thickness of 10 to 1.5 mm. The coiling temperature of hot rolling was varied. Annealing after hot rolling (in the present invention, referred to as "rough annealing") was performed for some sheets and not performed for other sheets. Further, reduction of cold rolling was varied. The sheets were formed into sheets of thickness of 1 mm by cold rolling, and then subjected to solution heat treatment at a temperature of 550° C. for 1 minute.

15% tensile deformation was given to the sheets, and then the surfaces of the sheets were coated and whether ridging marks were produced or not was examined (ridging marks are made more conspicuous by coating, that is, coating makes it easy to find ridging marks). Further, as an index of formability, critical height to cracking was measured by performing a stretch forming test in a plane strain tensile condition.

Measurement of textures were performed on three difference planes of each sheet after solution heat treatment, that is, a surface plane, a ¼-thickness plane, and a center-in-thickness plane. Specifically, conventional pole figures of (100), (110) and (111) were measured by an ordinary X-ray diffraction method using Cu as a target on the condition that X-ray tube voltage was 50kV and X-ray tube current was 200 mA. Then, using the crystallite orientation distribution function, orientation distribution density of each orientation was calculated on each of the above three planes. Then, as an orientation distribution density in the whole sheet, the average of orientation distribution densities on the three planes of a sheet was calculated.

Results are shown in Table 1. It is clear that production of ridging marks is restrained in the materials according to the present invention, and that those materials have good formability.

TABLE 1

Conditions of fabrication of alloys, textures, ridging marks, critical height to cracking in forming

| | Conditions of fabrication | | | Texture | | | | | |
|---|---|---|---|---|---|---|---|---|---|
| Alloy | Coiling Temperature of hot rolling (° C.) | Rough Annealing | Reduction of cold rolling (%) | Goss | PP | Brass | Ridging marks | Critical height to cracking in forming (mm) | Note |
| Base | 365 | Not performed | 75 | 2.8 | 2.8 | 2.7 | Not produced | 29.4 | Materials according to the present invention |
| Base | 410 | Not performed | 40 | 2.2 | 2.0 | 2.4 | Not produced | 29.7 | |
| Mn-added | 380 | Not performed | 75 | 2.9 | 2.7 | 2.8 | Not produced | 29.6 | |
| Mn-added | 365 | Performed | 75 | 2.0 | 1.9 | 1.6 | Not produced | 29.8 | |
| Mn-added | 420 | Not performed | 40 | 1.8 | 1.7 | 1.7 | Not produced | 29.9 | |
| Fe-added | 365 | Not performed | 75 | 2.9 | 2.7 | 2.8 | Not produced | 29.7 | |
| Fe-added | 365 | Performed | 75 | 2.2 | 1.7 | 2.0 | Not produced | 29.7 | |
| Fe-added | 390 | Not performed | 40 | 2.1 | 2.0 | 1.9 | Not produced | 29.8 | |
| Base | 355* | Not performed | 75 | 3.4 | 3.2 | 2.9 | Produced | 28.0 | Comparative materials |
| Base | 370 | Not performed | 90* | 4.2 | 3.6 | 3.2 | Produced | 27.5 | Comparative materials |
| Mn-added | 355* | Not performed | 75 | 4.7 | 3.1 | 3.8 | Produced | 27.8 | |

TABLE 1-continued

Conditions of fabrication of alloys, textures, ridging marks, critical height to cracking in forming

| Alloy | Conditions of fabrication: Coiling Temperature of hot rolling (° C.) | Rough Annealing | Reduction of cold rolling (%) | Texture: Goss | PP | Brass | Ridging marks | Critical height to cracking in forming (mm) | Note |
|---|---|---|---|---|---|---|---|---|---|
| Mn-added | 370 | Not performed | 90* | 5.1 | 3.4 | 4.0 | Produced | 27.4 | |
| Mn-added | 365 | Performed | 90* | 4.9 | 3.3 | 3.9 | Produced | 27.6 | |
| Fe-added | 360* | Not performed | 75 | 5.8 | 4.2 | 3.7 | Produced | 27.3 | |
| Fe-added | 370 | Not performed | 90* | 7.1 | 4.3 | 4.0 | Produced | 26.9 | |
| Fe-added | 355* | Performed | 75 | 6.4 | 3.9 | 3.8 | Produced | 27.0 | |

*Undesirable condition

EXAMPLE 2

Various alloys shown in Table 2 containing added elements such as Mg, Si, Mn, Cr, Fe, Zr, V, Ti and the like were cast in an ordinary way, and subjected to soaking at a temperature of 550° C. for 8 hours. Then, hot rolling was performed (starting temperature: 500° C.) to thereby form the alloys into sheets of thickness of 10 to 1.5 mm. The coiling temperature of hot rolling was varied. Rough annealing was not performed. The sheets were formed into sheets of thickness of 1 mm by cold rolling, and then subjected to solution heat treatment at a temperature of 550° C. for 1 minute.

TABLE 2

| No. | Alloy constituents (%): Mg | Si | Mn | Cr | Fe | Zr | V | Ti | |
|---|---|---|---|---|---|---|---|---|---|
| 1 | 1.5 | 1.5 | | | | | | | Materials according to the present invention |
| 2 | 1.0 | 0.6 | | | | | | 0.03 | |
| 3 | 0.3 | 0.3 | | | | | | 0.10 | |
| 4 | 0.6 | 1.2 | 0.2 | | 0.1 | 0.05 | | | |
| 5 | 0.6 | 1.2 | | 0.3 | 0.1 | | 0.05 | | |
| 6 | 0.6 | 1.2 | | | 0.1 | 0.3 | | | |
| 7 | 0.6 | 1.2 | | | 0.1 | | 0.3 | | |
| 8 | 0.6 | 1.2 | | | 1.0 | | | | |

TABLE 2-continued

| No. | Alloy constituents (%): Mg | Si | Mn | Cr | Fe | Zr | V | Ti | |
|---|---|---|---|---|---|---|---|---|---|
| 9 | 0.6 | 1.2 | 1.0 | | | | | | Comparative materials |
| 10 | 0.6 | 1.2 | 0.1 | 0.1 | 0.1 | | | | |
| 11 | 1.6* | 1.0 | | | | | | | |
| 12 | 1.0 | 1.6* | | | | | | | |
| 13 | 0.6 | 1.2 | 1.1* | | | | | | |
| 14 | 0.6 | 1.2 | | | 1.1* | | | | |
| 15 | 0.6 | 1.2 | | 0.4* | | | | | |
| 16 | 0.6 | 1.2 | | | | 0.4* | | | |
| 17 | 0.6 | 1.2 | | | | | 0.4* | | |
| 18 | 0.6 | 1.2 | | | | | | 0.15* | |

*Out of the range stipulated in the present invention

Regarding the obtained sheets, whether ridging marks were produced or not was examined, critical height to cracking was measured by a stretch forming test, and textures were measured as in embodiment 1.

Results are shown in Table 3. It is clear that production of ridging marks is restrained in the materials according to the present invention, and that those materials have good formability.

TABLE 3

Conditions of fabrication of alloys, textures, ridging marks, critical height to cracking in forming

| Alloy No. | Conditions of Fabrication: Coiling temperature of hot rolling (° C.) | Reduction of cold rolling (%) | Texture: Goss | Pp | Brass | Ridging marks | Critical height to cracking in forming (mm) | Note |
|---|---|---|---|---|---|---|---|---|
| 1 | 420 | 50 | 2.2 | 2.0 | 2.1 | Not produced | 29.7 | Materials according to the present invention |
| 2 | 410 | 80 | 2.4 | 2.1 | 1.9 | Not produced | 29.6 | |

TABLE 3-continued

| Alloy No. | Conditions of Fabrication: Coiling temperature of hot rolling (° C.) | Reduction of cold rolling (%) | Texture: Goss | Pp | Brass | Ridging marks | Critical height to cracking in forming (mm) | Note |
|---|---|---|---|---|---|---|---|---|
| | Conditions of fabrication of alloys, textures, ridging marks, critical height to cracking in forming | | | | | | | |
| 3 | 365 | 60 | 1.8 | 1.4 | 2.1 | Not produced | 29.9 | |
| 4 | 380 | 50 | 2.4 | 2.2 | 1.8 | Not produced | 29.6 | |
| 5 | 400 | 40 | 2.5 | 2.2 | 2.9 | Not produced | 29.4 | |
| 6 | 370 | 50 | 1.5 | 2.1 | 2.8 | Not produced | 29.8 | |
| 7 | 390 | 80 | 2.4 | 2.2 | 2.7 | Not produced | 29.5 | |
| 8 | 410 | 60 | 2.8 | 2.6 | 1.0 | Not produced | 29.6 | |
| 9 | 390 | 50 | 2.2 | 1.0 | 1.8 | Not produced | 29.8 | |
| 10 | 370 | 60 | 1.2 | 2.2 | 2.6 | Not produced | 29.8 | |
| 11 | 360 | 85 | 2.8 | 3.0 | 3.8 | Produced | 27.8 | Comparative materials |
| 12 | 330 | 50 | 3.6 | 3.4 | 2.5 | Produced | 27.5 | |
| 13 | 410 | 90 | 2.9 | 2.4 | 3.4 | Produced | 27.7 | |
| 14 | 380 | 80 | 3.8 | 3.2 | 2.4 | Produced | 27.4 | |
| 15 | 410 | 60 | 2.9 | 2.5 | 3.6 | Produced | 27.7 | |
| 16 | 340 | 80 | 3.1 | 3.0 | 3.9 | Produced | 27.3 | |
| 17 | 360 | 60 | 2.8 | 3.0 | 3.5 | Produced | 27.5 | |
| 18 | 370 | 50 | 3.1 | 3.4 | 3.1 | Produced | 27.1 | |

EXAMPLE 3

Various alloys shown in Table 4 containing added elements such as Mg, Si, Mn, Cr, Fe, Zr, V, Ti, Cu, Ag, Zn, Sn and the like were cast in an ordinary way, and subjected to soaking at a temperature of 550° C. for 8 hours. Then, hot rolling was performed (starting temperature: 500° C. ) to thereby form the alloys into sheets of thickness of 10 to 1.5 mm. The coiling temperature of hot rolling was varied. Rough annealing was not performed. The sheets were formed into sheets of thickness of 1 mm by cold rolling, and then subjected to solution heat treatment at a temperature of 550° C. for 1 minute.

TABLE 4

| No. | Mg | Si | Mn | Cr | Fe | Zr | Ti | Cu | Ag | Zn | Sn | |
|---|---|---|---|---|---|---|---|---|---|---|---|---|
| | Alloy constituents (%) | | | | | | | | | | | |
| 19 | 0.6 | 1.2 | 0.2 | | 0.1 | | | 1.0 | | | | Materials according to the present invention |
| 20 | 0.6 | 1.2 | 0.2 | | 0.1 | | | 0.5 | | | | |
| 21 | 0.6 | 1.2 | | | 0.1 | 0.1 | | | 0.2 | | | |
| 22 | 0.6 | 1.2 | | | 0.1 | 0.1 | | | 0.1 | | | |
| 23 | 0.8 | 1.0 | 0.1 | 0.1 | | | | | | 1.0 | | |
| 24 | 0.8 | 1.0 | 0.1 | 0.1 | | | | | | 0.5 | | |
| 25 | 1.0 | 0.6 | 0.1 | | 0.1 | | 0.05 | | | | 0.2 | |
| 26 | 1.0 | 0.6 | 0.1 | | 0.1 | | 0.1 | | | | 0.1 | |
| 27 | 0.6 | 1.2 | 0.2 | | 0.1 | | | 1.1* | | | | Comparative materials |
| 28 | 0.6 | 1.2 | 0.2 | | 0.1 | | | | 0.3* | | | |
| 29 | 0.6 | 1.2 | 0.2 | | 0.1 | | | | | 1.1* | | |
| 30 | 0.6 | 1.2 | 0.2 | | 0.1 | | | | | | 0.3* | |
| 31 | 0.6 | 1.2 | 1.1* | | | | | 0.5 | | | | |
| 32 | 0.6 | 1.6* | 0.2 | | 0.1 | | | | 0.2 | | 0.1 | |
| 33 | 1.6* | 1.2 | 0.2 | | 0.1 | | | | | 0.5 | | |

*Out of the range stipulated in the present invention

Regarding the obtained sheets, whether ridging marks were produced or not was examined, critical height to cracking was measured by a stretch forming test, and textures were measured as in embodiment 1.

Results are shown in Table 5. It is clear that production of ridging marks is restrained in the materials according to the present invention, and that those materials have good formability.

TABLE 5

Conditions of fabrication of alloys, textures, ridging marks, critical height to cracking in forming

| Alloy No. | Conditions of fabrication: Coiling temperature of hot rolling (° C.) | Conditions of fabrication: Reduction of cold rolling (%) | Texture: Goss | Texture: PP | Texture: Brass | Ridging marks | Critical height to cracking in forming (mm) | Note |
|---|---|---|---|---|---|---|---|---|
| 19 | 410 | 70 | 2.6 | 2.3 | 2.8 | Not produced | 29.4 | Materials according to the present invention |
| 20 | 380 | 50 | 1.9 | 2.2 | 2.4 | Not produced | 29.6 | |
| 21 | 420 | 80 | 2.4 | 1.2 | 2.8 | Not produced | 29.6 | |
| 22 | 370 | 60 | 2.3 | 2.2 | 2.7 | Not produced | 29.5 | |
| 23 | 410 | 50 | 2.4 | 2.1 | 2.8 | Not produced | 29.5 | |
| 24 | 370 | 50 | 2.5 | 2.2 | 1.9 | Not produced | 29.7 | |
| 25 | 420 | 70 | 2.6 | 2.4 | 2.9 | Not produced | 29.4 | |
| 26 | 380 | 40 | 1.5 | 2.2 | 1.8 | Not produced | 29.8 | |
| 27 | 390 | 85 | 3.1 | 2.8 | 3.6 | Produced | 27.4 | Comparative materials |
| 28 | 380 | 50 | 3.4 | 3.0 | 3.3 | Produced | 27.5 | |
| 29 | 370 | 60 | 3.1 | 3.0 | 3.3 | Produced | 27.6 | |
| 30 | 390 | 80 | 3.2 | 3.2 | 3.9 | Produced | 27.2 | |
| 31 | 380 | 70 | 3.0 | 2.6 | 3.8 | Produced | 27.4 | |
| 32 | 360 | 60 | 3.6 | 3.0 | 3.4 | Produced | 27.1 | |
| 33 | 380 | 70 | 3.2 | 3.1 | 4.1 | Produced | 27.2 | |

What is claimed is:

1. An Al—Mg—Si aluminum alloy sheet for forming which has textures in which orientation distribution density of Goss orientation is 3 or lower, orientation distribution density of PP orientation is 3 or lower and orientation distribution density of Brass orientation is 3 or lower.

2. The Al—Mg—Si aluminum alloy sheet for forming according to claim 1, wherein said Al—Mg—Si aluminum alloy sheet contains, as alloy constituents, 0.2 to 1.5 wt % of Mg and 0.2 to 1.5 wt % of Si.

3. The Al—Mg—Si aluminum alloy sheet for forming according to claim 2, wherein said Al—Mg—Si aluminum alloy sheet further contains, as alloy constituents, 0.01 to 1.5 wt % in total weight of one or more elements selected from a group consisting of 1.0 wt % or less of Mn, 0.3 wt % or less of Cr, 1.0 wt % or less of Fe, 0.3 wt % or less of Zr, 0.3 wt % or less of V and 0.1 wt % or less of Ti.

4. The Al—Mg—Si aluminum alloy sheet for forming according to claim 2, wherein said Al—Mg—Si aluminum alloy sheet further contains, as alloy constituents, 0.01 to 1.5 wt % in total weight of one or more elements selected from a group consisting of 1.0 wt % or less of Cu, 0.2 wt % or less of Ag, 1.0 wt % or less of Zn and 0.2 wt % or less of Sn.

5. The Al—Mg—Si aluminum alloy sheet for forming according to claim 3, wherein said Al—Mg—Si aluminum alloy sheet further contains, as alloy constituents, 0.01 to 1.5 wt % in total weight of one or more elements selected from a group consisting of 1.0 wt % or less of Cu. 0.2 wt % or less of Ag, 1.0 wt % or less of Zn and 0.2 wt % or less of Sn.

6. The Al—Mg—Si aluminum alloy sheet for forming according to claim 1, wherein said orientation distribution density of Goss orientation is 2 or lower, said orientation distribution density of PP orientation is 2 or lower and said orientation distribution density of Brass orientation is 2 or lower.

* * * * *

UNITED STATES PATENT AND TRADEMARK OFFICE

CERTIFICATE OF CORRECTION

PATENT NO. : 6,231,809 B1
DATED : May 15, 2001
INVENTOR(S) : Matsumoto et al.

It is certified that error appears in the above-identified patent and that said Letters Patent is hereby corrected as shown below:

Title page,
Item [30], the Foreign Application Priority Data should be omitted.

Item [73], the 2nd Assignees's name is incorrect. It should read.

[73] Assignees: Kabushiki Kaisha Kobe Seiko Sho (Kobe Steel, Ltd.), Kobe; Kobe Alcoa Transportation Products Ltd., Tokyo, both of (JP)

Signed and Sealed this

Twenty-fifth Day of December, 2001

*Attest:*

*Attesting Officer*

JAMES E. ROGAN
*Director of the United States Patent and Trademark Office*